US005193792A

United States Patent [19]

Di Marco

[11] Patent Number: 5,193,792

[45] Date of Patent: Mar. 16, 1993

[54] SOFT JAW ATTACHMENT SYSTEM FOR A VISE

[76] Inventor: Joel Di Marco, P.O. Box 1139, Littlerock, Calif. 93543

[21] Appl. No.: 836,216

[22] Filed: Feb. 10, 1992

[51] Int. Cl.[5] ..... B25B 1/24

[52] U.S. Cl. ..... 269/282; 269/271; 269/275; 269/279; 269/286

[58] Field of Search ..... 269/271, 275, 279-284, 269/286; 294/90

[56] References Cited

U.S. PATENT DOCUMENTS

| | | | |
|---|---|---|---|
| 758,838 | 5/1904 | Hermann | 269/280 |
| 994,240 | 6/1911 | Bingham | 269/271 |
| 3,565,417 | 2/1971 | Degle | 269/281 |
| 3,891,260 | 6/1975 | Kuhn | 294/90 |
| 4,569,509 | 2/1986 | Good | 269/32 |
| 4,945,781 | 8/1990 | Isert | 74/424.8 A |

FOREIGN PATENT DOCUMENTS

| | | | |
|---|---|---|---|
| 1173399 | 7/1964 | Fed. Rep. of Germany | 269/275 |
| 1237780 | 6/1960 | France | 269/282 |

*Primary Examiner*—J. J. Swann

*Attorney, Agent, or Firm*—William H. Maxwell

[57] ABSTRACT

A soft jaw attachment to machine vises having precision ways and flat vise jaw faces with widely spaced fastener openings through said vice jaw faces, the soft jaw being an elongated bar of resilient material having a flat face to interface with the vice jaw face, an element of the fastener means being of T-shape engaged in a complementary channel in the soft jaw, the soft jaw being arcuately prestressed and drawn tightly into flat contiguous interengagement with the jaw face; and an embodiment wherein the fastener element is an elongated and resilient prestressed bar; either or both the soft jaw or the fastener element being prestressed: tightness of the soft jaw to the vice jaw being ensured.

9 Claims, 4 Drawing Sheets

SOFT JAW ATTACHMENT SYSTEM FOR A VISE

BACKGROUND OF THE INVENTION

Vises are used in machine work in many ways and are referred to generally as machine vises, holding accuracy being a requirement, especially for production work; whether it be a bench vise, or a machine tool vise. For example, a milling machine vises are universally used and characterized by the installation thereon of soft jaws adapted to the particular work piece configuration involved. It is this soft jaw installation with which this invention is concerned, it being a general object of this invention to provide inherently accurate soft jaw installation in machine vises as they are commonly manufactured and with but slight modification thereto in some instances.

Machine vises are of high quality, in that the jaw faces are and remain parallel. Vise construction varies, a typical machine vise involving a base with accurately ground ways upon which a fixed jaw and a moveable clamp jaw are accurately mounted, and the opposing faces of the jaws ground flat and parallel one with the other. It is an object of this invention to ensure duplication of said jaw parallelism in the soft jaws separately applied thereto. In practice, each vise jaw has widely spaced threaded openings to receive fasteners that secure the soft jaws in working position. Accordingly, the machine vise receives jaws that are replaceable.

Heretofore, difficulty has been experienced in accurately installing soft jaws or the like to the flat accurately machined faces of the vise jaws. That is, the soft jaws have not always seated flat and/or contiguous to the vise jaw faces, and most often develop looseness between and away from the widely spaced fasteners. A solution to this problem has been to add features such as intermediate screw fasteners, but this may not be possible with some vise constructions, and in any case is a redundant measure, costly and time consuming; also requiring checking procedures with dial indicators and the like. Accordingly, it is an object of this invention to advantageously utilize the existing widely spaced fastener openings, without resort to redundant screw fasteners or costly mechanical arrangements, and without any additional parts other than the basic soft jaw and a pair of fasteners, in each instance.

A desirable feature for a soft jaw is that it be devoid of any intrusion upon its working face. In other words, that its working face be unobstructed and of substantial thickness for adaptation to a work piece. In this respect, the soft jaw employed herein is characterized by its T-slot configuration, much the same as employed in my U.S. Pat. No. 4,898,371 issued Feb. 6, 1990. However, the complexities of my said patent are avoided herein and a special vise construction is not required.

It is an object of this invention to employ T-slot soft jaws with T-nut fasteners or the like, whereby the soft jaws are pulled coextensively to the machine faces of the vise jaws. In carrying out this invention, it is an object to prestress the soft jaw installation whereby the soft jaw is pulled coextensively tight into the vise jaw face. In the basic embodiment of this invention the soft jaw per se is prestressed by arcuately forming the same and is secured to the vise jaw face by straight and flat T-nuts or a T-bar. In a second embodiment of this invention the soft jaw is straight and flat while the T-bar is prestressed by arcuately forming the same. In a third embodiment of this invention the T-nuts are reversely prestressed by arcuately forming the same. And, in a fourth embodiment of this invention both the soft jaw and T-bar are prestressed by arcuately forming the same.

The precision jaws of a machine vise are characteristically of limited height, for example 1.5 inch, whereas the height requirements of soft jaws is often substantially greater. However, this increased height has been restricted in the past, due to the inherent weakness in the soft jaw metal, for example aluminum, commonly used in their construction. Accordingly, it is an object of this invention to reinforce the extended height of soft jaws with the fastener means employed to secure the same to the vise jaws. In carrying out this invention, the fastener means is preferably an elongated T-nut or T-bar configuration and made of durable steel that has considerably higher strength properties than soft aluminum and the like. In practice, the fastener means is what will be referred to as a T-bar and made of high tensile heat treated steel or the like. It is to be understood that the material quality of the reinforcement fastener means can vary as required.

SUMMARY OF THE INVENTION

This invention relates to the machine tool industry where vises are employed to secure work pieces, especially in high production job work. Thus, it is the accurate replacement of the work piece that is required, and to this end soft jaws are constantly replaced in the machine vises to secure the work piece changes. Since the soft jaws are replaceable, means is provided by this invention to ensure accurate placement and replacement of the soft jaws onto the vise jaws, utilizing the few minimum number of parts and elements that exist in the basic state of the art of machine vise and soft jaw combinations. In practicing this invention, by prestressing the soft jaw element or elements as they are herein shown and described, a reliably accurate soft jaw installation is inherently attained. Characteristically, the machine vise is provided with accurately faced parallel jaws having pairs of widely spaced fastener openings. In accordance with this invention, the soft jaws per se and/or the fastener or fasteners therefor are prestressed between and/or to either side of the openings. A feature is the reinforcement that is provided by the fastener means in the form of one or more T-bars of higher tensile strength than that of the soft jaws, whereby the height of the soft jaws can be successfully maximized with reliability.

The foregoing and various other objects and features of this invention will be apparent and fully understood from the following detailed description of the typical preferred forms and applications thereof, throughout which description reference is made to the accompanying drawings.

THE DRAWINGS

Figure 11:
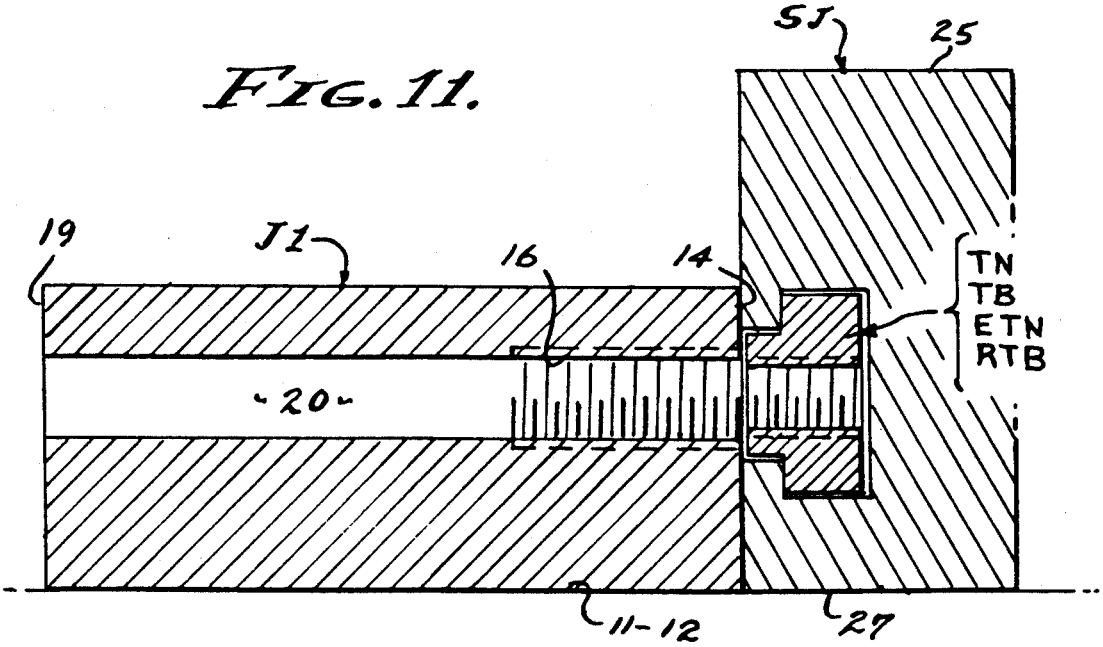

And, FIG. 11 is an enlarged detailed sectional view of a moveable vise jaw and soft jaw arranged in readiness for installation of the fastener means, a cap screw or bolt, and illustrating a modified fastener opening.

Note that the clearance and prestress cambers of the parts and elements shown in the aforesaid drawing figures are exaggerated for the purpose of illustration.

PREFERRED EMBODIMENT

Figure 1:
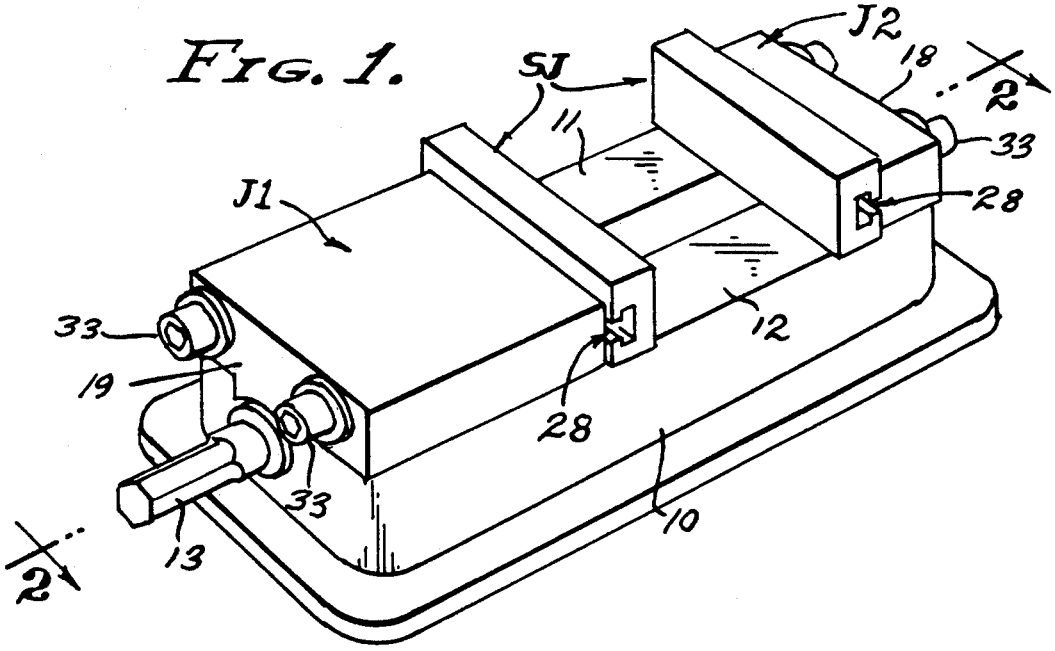
FIG. 1 is a perspective view of a typical machine vise and illustrating installation of the prestressed soft jaws of the present invention.
Figure 2:
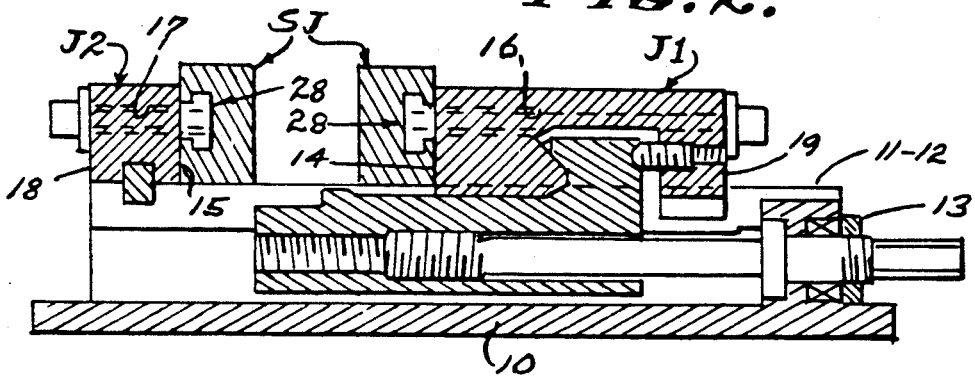
FIG. 2 is a sectional view taken as indicated by line 2—2 on FIG. 1.

Referring now to the drawings, FIGS. 1 and 2 show a conventional machine vise construction having a base 10 with longitudinally disposed upwardly faced ways 11 and 12 in a common horizontal plane and between which there is a screw and nut operating means 13 to shift a moveable vise jaw J1 into opposition to a fixed vise jaw J2. Said vise jaws have accurately machined parallel faces 14 and 15 disposed in transverse planes normal to the horizontal plane of the ways 11 and 12. In a typical milling machine vise, as shown, the jaws J1 and J2 are 6.0 inches wide and 1.5 inches high, with a pair of threaded fastener openings 16 and 17 entering the faces 14 and 15 for installing opposed soft jaws SJ, which are alike, as will be described. Typically, openings 16 and 17 are transversely spaced 3.875 inch, 1.937 inch above the plane of ways 11 and 12, and one parallel to the other. In the case of the fixed vise jaw J2 the threaded fastener openings 17 are through openings, open at both the jaw face 15 and the back 18 of the jaw. However, in the usual case of the longer moveable jaw J2 the threaded fastener openings 16 are blind openings, bottoming at a substantial depth within the vice jaw body, (not shown), the back 19 of the jaw being clear and imperforate (not shown). As clearly shown in FIG. 11 the threaded fastener openings 16 are drilled out at 20 to open at said back 19 of the vise body, at a diameter equal to or less than the minor or root diameter of the threads therein. For example, the threaded fastener openings 16 and 17 are customarily ½ inch 13 thread per inch, having a minor or root diameter of 0.428 inch. Accordingly, the drilled openings 20 are 0.422 inch diameter to receive a ⅜ inch 16 thread per inch bolt, stud or cap screw as shown. These two drilled holes are the only modification that may be required in order to install the prestressed soft jaws, as shown and hereinafter described.

It is to be understood that the vise jaws J1 and J2 are essentially alike insofar as the present invention is concerned, the only difference being length and backside access to the threaded fastener openings 16 and 17 in conventional vises. Therefore, the only difference in the instant soft jaw installation is the length of the bolt, stud or cap screw.

Figure 5:
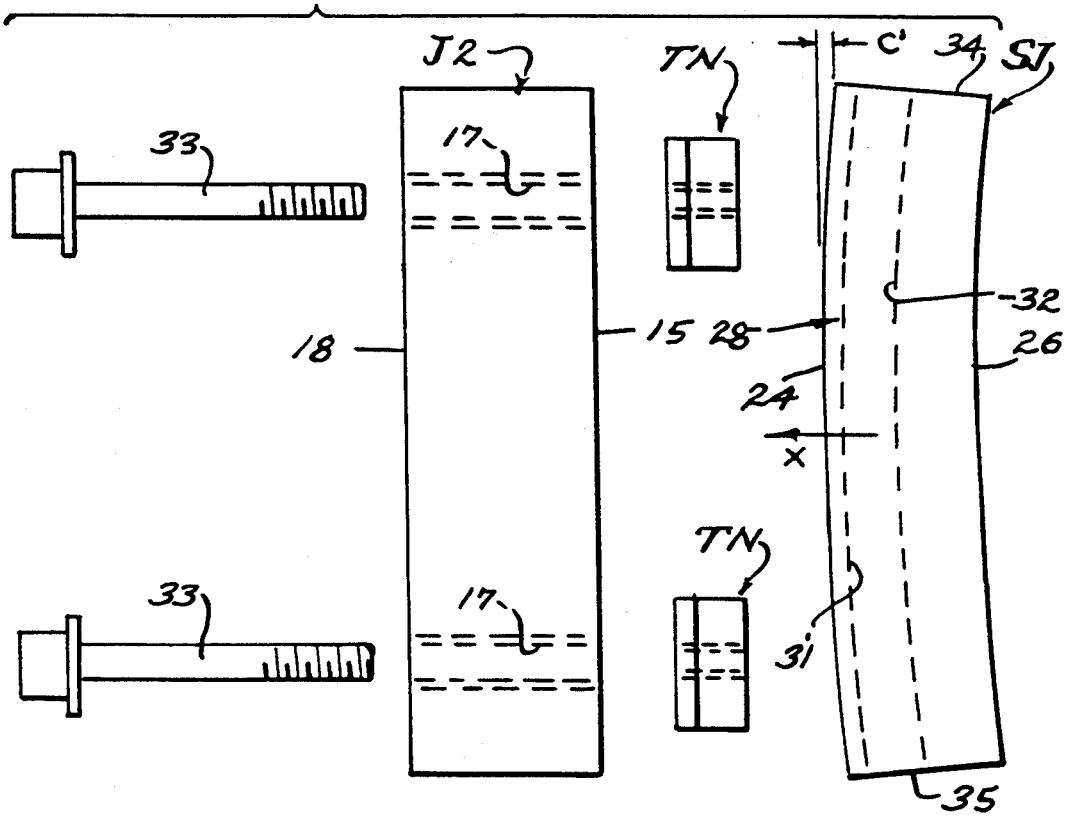
FIG. 5 is an exploded view illustrating the vise and soft jaw assembly in an embodiment wherein the soft jaw per se is prestressed.

Referring now to FIG. 5 and the first and basic embodiment of this invention, the vise jaw J2 (J1) is as above described, having an accurately machined jaw face 15 (14) through which the opening 17 (16 and 20) pass to the back 18 (19) of the vise jaw body. As shown, said fastener openings are widely spaced parallel openings, one at each side of the vise jaw. The jaw face 15 (14) is normal at 90° to a longitudinal axis and to the horizontal plane of the ways 11 and 12, and it is to this accurately machined face 15 (14) that the soft jaw SJ is applied.

In accordance with this invention, a workpiece is secured by clamped engagement between opposed soft jaws SJ installed upon opposed vise jaw faces 14 and 15, so as to have tight interface engagement therewith. Accordingly, the soft jaw SJ is a transversely elongated body having a backside face 24 to interface coextensively with the vise jaw face 14 (15), and it has a parallel frontside face 26. The soft jaw faces are in opposition to clamp a workpiece in working position, the soft jaws SJ being of substantial thickness between the faces 24 and 26.

The soft jaws SJ are of the type characterized by unobstructed frontside faces 26, achieved by extruding the same of, for example, aluminum that is readily machined and which has resilience. In practice, readily available 6063 T5 aluminum; or a harder 6061 T6 aluminum can be employed; or a 7075 T7 aluminum may be required. In any case, the soft jaw body is accurately extruded of said or equivalent material having a coextensively flat and unobstructed frontside face 26 as shown. Also, with coextensively flat and unobstructed top and bottom sides 25 and 27. However, the backside face 24 features a coextensive longitudinally disposed T-slot channel 28 having top and bottom retaining flanges 29 and 30 having inwardly flared shoulders 31 in a common plane. The shoulders 31 face away from the backside face 24 and oppose a channel bottom 32 and accommodate a complementary T-nut. The elements and/or features 24–32 of the extrusion are accurately parallel one with the other, as shown.

Figure 3:
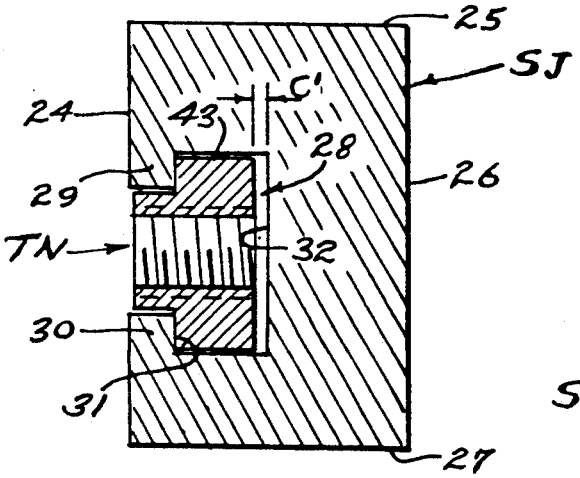
FIGS. 3 and 4 are enlarged detailed sectional views of one of the soft jaws as shown in FIG. 1, FIG. 3 illustrating assembly clearance of a convexly prestressed fastener means, and FIG. 4 illustrating assembly clearance of a concavely prestressed fastener means.

As clearly shown in FIG. 3 of the drawings, the T-nut TN is a threaded part adapted to be captured in the T-slot by the inwardly faced shoulders 31, having a threaded opening to align with the opening 17 (16) through the vise jaw J2 (J1). In practice, the T-nut occupies a small area surrounding the opening 17 (16) and receives a threaded fastener 33 offered through said opening from the back 18 (19) of the vise jaw body. Thus, widely spaced threadedly engaged T-nuts draw the soft jaw SJ backside face 24 into tight engagement at and immediately surrounding said fasteners 33. In practice, the fasteners 33 are bolts, or studs, or cap screws as shown. Washers are used to protect the back of the vise jaw body.

In accordance with this invention, the soft jaw SJ and fastener means T-nut and fastener 33 assembly is prestressed so as to draw the soft jaw backside face 24 into coextensively tight engagement with the vise jaw J2 (J1) face 15 (14). In the first embodiment now under consideration, prestress is provided in the soft jaw SJ per se, by convexly forming the backside face 24 so as to be positively cambered between its transversely spaced sides 34 and 35. In practice, the camber c' can range from 0.005 to 0.025, and more or less dependent upon the size of jaw and material employed therefor. Consequently, when the fasteners 33 are tightened into the T-nuts TN, the soft jaw SJ is flattened and gradually applies prestress pressures from the center thereof as shown by the arrow x in FIG. 5. The T-nuts TN are made to slide loosely into the T-slot channel 28 with clearance as shown.

The prestressed element, the soft jaw SJ in the first embodiment, is primarily a straight right angular solid of rectangular cross section having two pairs of accurately spaced parallel side faces 24 and 26. The bottom side 27 interfaces with the plane of the ways 11 and 12, while the backside face 24 interfaces with the machined face 15 (14) of the vise jaw J2 (J1). The soft jaw face 26 and top side 25 are adapted to the shape and configuration of the workpiece, which is common practice. In accordance with this invention, the above described straight solid element is formed into arcuate configuration and is thereby prestressed with a slight convex camber c' having a crest centered midway between the fastener openings 17 (16). When the opposite end portions of the soft jaws SJ are drawn into contiguous engagement with the vise jaw face 15 (14), then the intermediate center portion of the soft jaw applies pressure against face 15 (14) thereby ensuring coextensive contiguous interengagement of the soft jaw face 24 with the vise jaw face 15 (14). Accordingly, the arcuately formed soft jaw resumes its original straight configuration.

Figure 6:
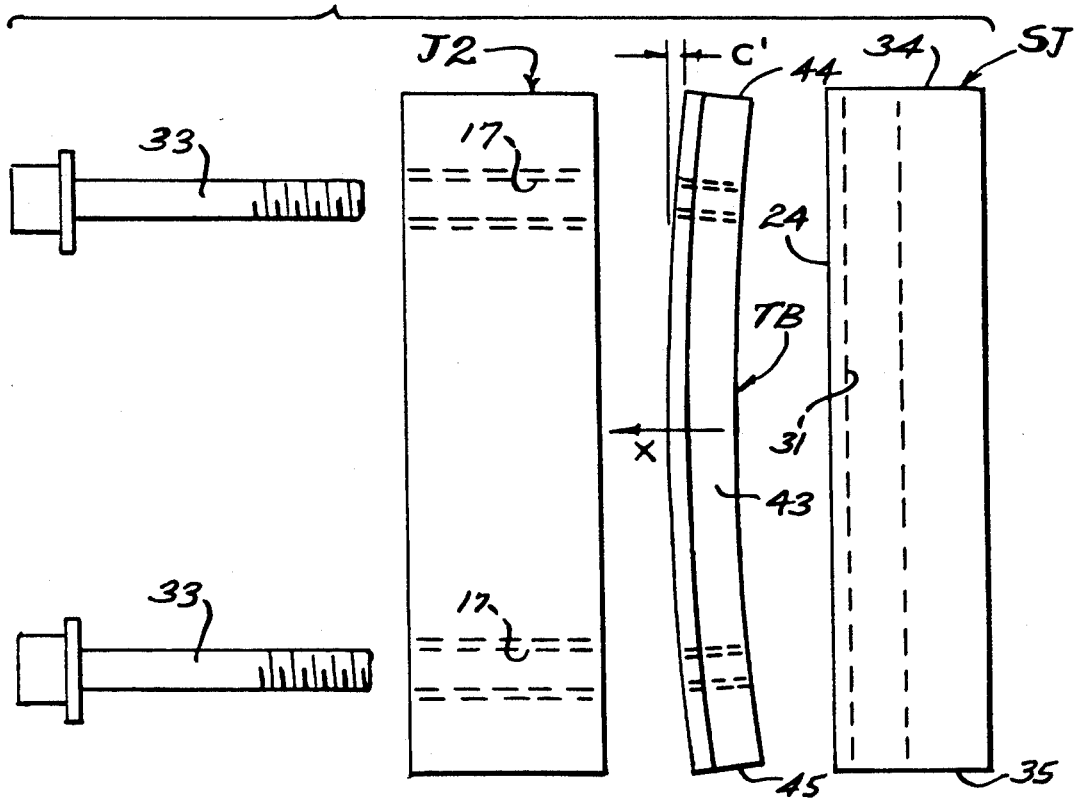
FIG. 6 is an exploded view illustrating the vise and soft jaw assembly in an embodiment wherein the fastener means, a T-bar, is prestressed.

Referring now to FIG. 6 and the second embodiment of this invention, the prestressed element is the fastener means, the soft jaw SJ element remaining a straight right angular solid of rectangular cross section as hereinabove described. The said soft jaw per se is not prestressed whereas it is the T-shaped nut element in the form of an elongated T-bar TB that is prestressed, so as to be drawn tightly into coextensive engagement with the shoulders 31 of the T-slot channel 28. In practice, the T-bar is a machined, rolled or extruded and resilient member made of readily available steel, such as cold-rolled steel which can be heat treated and/or hardened to provide a spring effect, or a spring steel brought to spring temper, or a heat treated tool steel such as 4130. The cross section of its parallel features are complementary to the T-slot as shown and hereinabove described.

As clearly shown in FIG. 6 of the drawings, the T-bar TB is a double threaded part adapted to be captured in the T-slot channel 28 by the inwardly faced shoulders 31 thereof, having spaced threaded openings to align with the openings 17 (16) through the vise jaw J2 (J1). In this second embodiment the T-bar is coextensive with the T-slot channel and is prestressed by convexly forming its rails 43 so as to be cambered at c' between its transversely opposite ends 44 and 45. In practice, the convex camber c' is the same as that hereinabove described as applied in the first embodiment, the T-slot channel 28 being provided with clearance c to accommodate said camber height. Consequently, when the opposite side fasteners 33 are tightened into the T-bar TB, said T-bar is flattened and gradually applies prestress from the center thereof as shown by the arrow x in FIG. 6. The T-bar TB is made to slide loosely into the T-slot channel 28 with the aid of clearance c, as shown in FIG. 3.

The prestressed element, the T-bar TB in the second embodiment, is primarily a straight solid of T-shaped cross section having parallel features as shown. In accordance with this invention, the above described straight and solid T-bar element is formed into arcuate configuration and is thereby prestressed with a slight convex and positive camber c' having a crest centered midway between the fastener openings 17 (16). When the opposite end portions of the T-bar TB are drawn into contiguous engagement with the T-slot channel shoulders 31, then the intermediate center portion of the T-bar applies pressure against shoulders 31 so as to apply pressure against face 15 (14) thereby ensuring coextensive contiguous interengagement of the soft jaw face 24 with the vise jaw face 15 (14). Accordingly, the arcuately formed T-bar resumes its original straight configuration.

Figure 7:
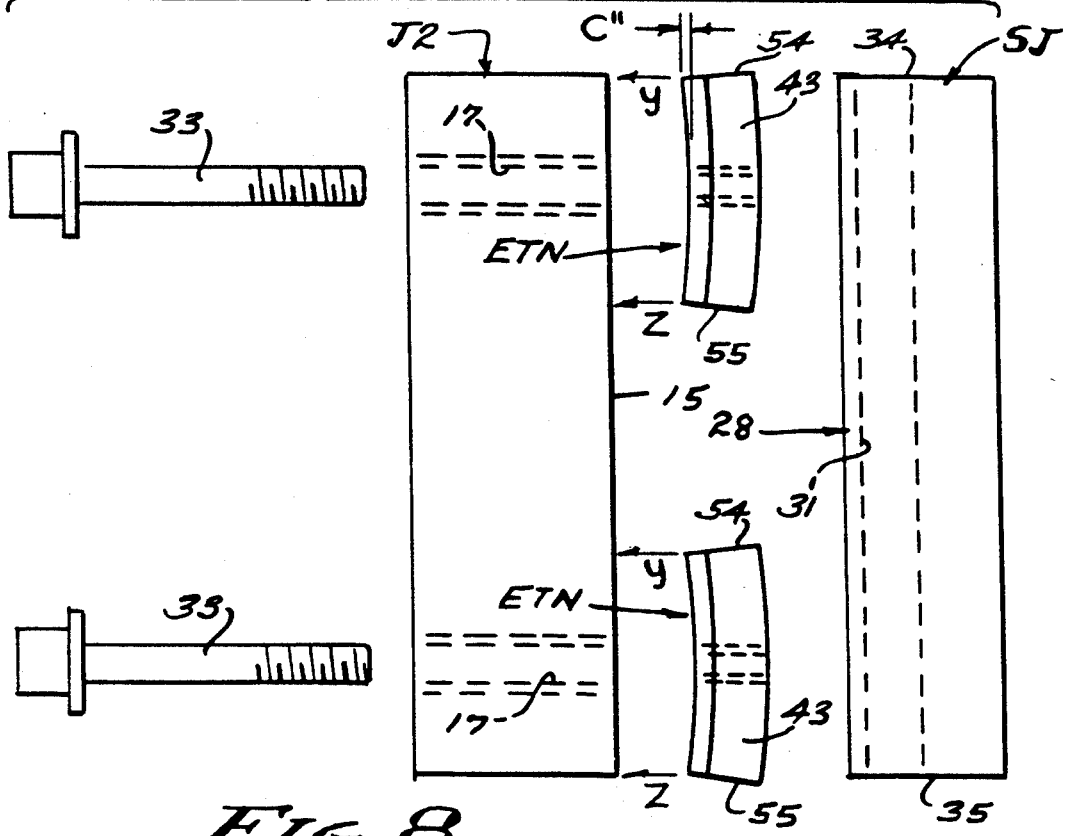
FIG. 7 is an exploded view illustrating the vise and soft jaw assembly in an embodiment wherein a pair of fastener means, T-nuts, are individually prestressed.
Figure 10:
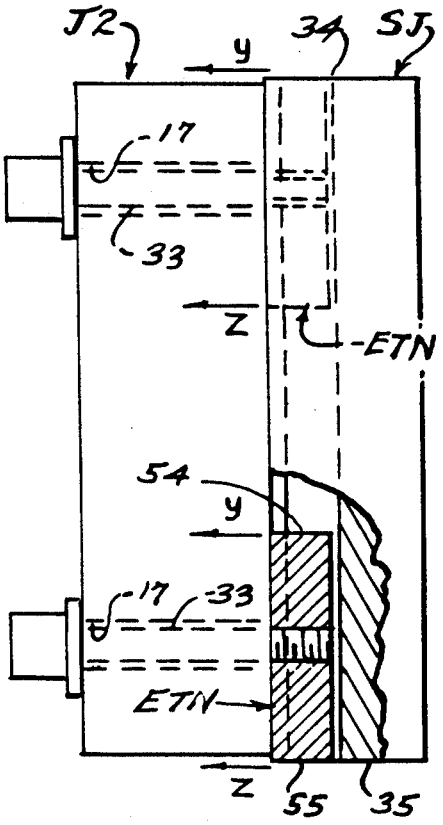

Referring now to FIG. 7 and the third embodiment of this invention, pressure is distributed by a pair of prestressed elements of the fastener means, the soft jaw SJ element remaining a straight right angular solid of rectangular cross section as hereinabove described. The said soft jaw per se is not prestressed whereas it is the T-shaped nut elements in the form of elongated T-nuts ETN that are prestressed, so as to be drawn tightly into coextensive engagement with the shoulders 31 of the T-slot channel 28 (see FIG. 10). In practice, the elongated T-nuts are machined, rolled or extruded and resilient members made of readily available steel, such as cold-rolled steel which can be heat treated and/or hardened to provide a spring effect, or a spring steel brought to spring temper, or a heat treated tool steel such as 4130. The cross section of its parallel features are complementary to the T-slot as shown and hereinabove described.

Figure 4:
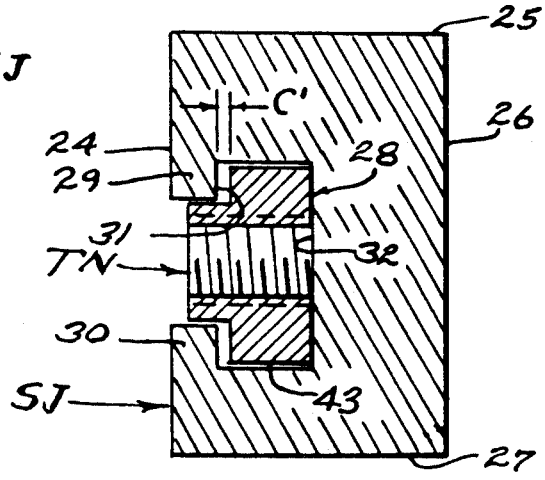

As clearly shown in FIG. 7 of the drawings, the T-nuts are of substantial length with ends 54 and 55 and adapted to be captured in the T-slot channel 28 by the inwardly faced shoulders 31 thereof, each having a threaded opening to align with an opening 17 (16) through the vise jaw J2 (J1). In this third embodiment the elongated T-nuts extend equidistantly from the threaded openings therein and are prestressed by concavely forming the rails 43 so as to reversely or negatively camber them at c'' between their transversely opposite ends 54 and 55. That is, the elongate T-nuts ETN are cambered away from the shoulders 31 to be pressured thereby (see FIG. 7). In practice, the concaved camber c'' is similar to the convex camber of the first embodiment, the T-slot channel 28 being provided with clearance c to accommodate said camber (see FIG. 4). Consequently, when the opposite side fasteners 33 are tightened into the elongated T-nuts ETN, said T-nuts are flattened and gradually apply prestress from the opposite ends thereof as shown by the arrows y and z in FIG. 7. The T-nuts ETN are made to slide loosely into the T-slot channel 28 with the aid of clearance c, as shown in FIG. 4.

The prestressed elements, the elongated T-nuts ETN in the third embodiment, are primarily straight solids of T-shaped cross section having parallel features as shown. In accordance with this invention, the above described straight and solid elongated nut element is formed into arcuate configuration and is thereby prestressed with a slight reversely concaved camber c'' having a crest centered at the fastener openings 17 (16). When the opposite ends 54 and 55 of the elongated T-nuts ETN are drawn into contiguous engagement with the T-slot channel shoulders 31, pressure is applied at equidistant positions y and z by each T-nut, whereby pressure is applied to the shoulders 31 at four positions or points as clearly shown by the two sets of arrows y and z in FIG. 7, thereby ensuring coextensive contiguous interengagement of the soft jaw face 24 with the vise jaw face 15 (14). Accordingly, the arcuately formed elongated T-nuts resume their original straight configuration.

Figure 8:
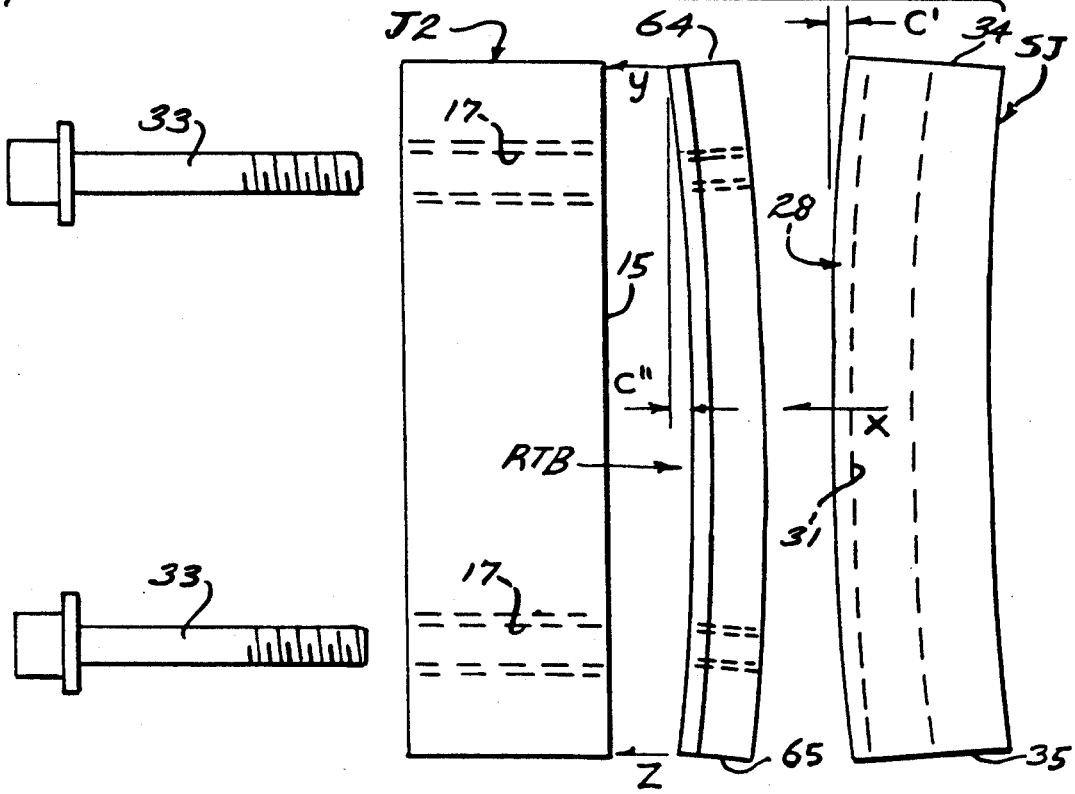
FIG. 8 is an exploded view illustrating the vise and soft jaw assembly in an embodiment wherein both the soft jaw and the fastener means, a T-bar, are prestressed.
Figure 9:
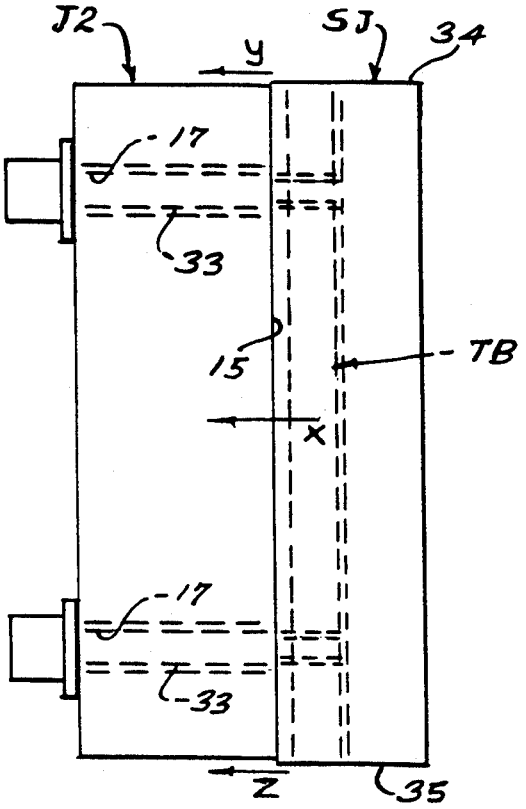
FIGS. 9 and 10 are fixed vise jaw and soft jaw installation views, FIG. 9 illustrating the embodiments of FIGS. 6 or 8, and FIG. 10 illustrating the embodiments of FIGS. 5 or 7 (particularly FIG. 7).

Referring now to FIG. 8 and the fourth embodiment of this invention, the fastener means T-bar RTB element and the soft jaw SJ element are both prestressed as hereinabove described. The T-shaped nut element in the form of an elongated T-bar is reversely prestressed, so as to be drawn tightly into end engagement with the shoulders 31 of the T-slot channel 28. And, the soft jaw SJ in the form of an elongated bar coextensive with the T-bar is prestressed, so as to be drawn tightly into coextensive engagement with the vice jaw face 15 (14). In practice, the T-bar and soft jaw are machined, rolled or extruded and resilient members made as hereinabove described, with cross sectional features complementary to the T-slot as shown and described.

As clearly shown in FIG. 8 of the drawings, the reversely prestressed T-bar RTB is a double threaded part adapted to be captured in the T-slot channel 28 by the inwardly faced shoulders 31 thereof, having spaced threaded openings to align with the openings 17 (16) through the vise jaw J2 (J1). In this fourth embodiment the T-bar is coextensive with the T-slot channel and is prestressed by concavely forming its rails 43 so as to be cambered negatively at c″ between its transversely spaced opposite ends 64 and 65. That is, the reversely prestressed T-bar RTB is cambered away from the shoulders 31 to be pressured thereby (see FIG. 8). In practice, the concaved camber c″ is similar to that hereinabove described as applied in the third embodiment, the T-slot channel 28 being provided with clearance c to accommodate said camber height (see FIG. 4). And, the convex soft jaw camber c′ is the same as that hereinabove described as applied in the first embodiment. Consequently, when the opposite side fasteners 33 are tightened into the T-bar RTB, said T-bar is flattened and gradually applies prestress from its opposite ends 64 and 65, as shown by arrows y and z in FIG. 8, and the soft jaw SJ n is flattened and gradually applies prestress from the center thereof as shown by the arrow x in FIG. 8. The T-bar RTB is made to slide loosely into the T-slot channel 28 with the aid of clearance c, as shown in FIG. 4.

The prestressed elements, the T-bar RTB and the soft jaw SJ in the fourth embodiment, are primarily straight solids of T-shaped cross section having parallel features as shown. In accordance with this invention, the above described straight and solid T-bar element is formed into arcuate configuration and is thereby prestressed with a slight concaved camber c″ having a crest centered midway between the fastener openings 17 (16). When the opposite end portions of the T-bar RTB are drawn into contiguous engagement with the T-slot channel shoulders 31, then the opposite ends 64 and 65 of the T-bar apply pressure against shoulders 31 at y and z, so as to force the opposite end portions 34 and 35 of the soft jaw SJ into engagement with face 15 (14) of the vise jaw, thereby ensuring coextensive contiguous interengagement of the soft jaw face 24 with the vise jaw face 15 (14). Accordingly, the arcuately formed T-bar RTB and soft jaw SJ resume their original straight configurations.

The soft jaw attachment of the present invention is unique in that it provides means that ensures tight interface engagement of the soft jaw to the vice jaw. Heretofore, complicated schemes have been resorted to, at great expense and loss of time, and dependent upon precision devices having limitations with respect to workpiece accommodation and typically skilled labor intensive. However, the ordinary prior art soft jaw concept of a flat machinable bar attached to an accurately finished jaw face by a pair of widely spaced fasteners is as basic and practical as is possible, but with the disadvantage that soft jaw looseness is likely to occur between said spaced fasteners. This invention virtually eliminates the looseness problem and ensures tightness, simply by drawing the arcuate soft jaw and/or T-shaped fastener means into flat coextensive contiguous interengagement. In practice, the arcuate camber is slight, almost imperceptible, and built into said prestressed members so that they can only be properly assembled, without mistake. Accordingly, each and every soft jaw installation can be relied upon for its tightness, when the soft jaws are properly engaged upon the vice ways.

Having described only the typical preferred forms and applications of my invention, I do not wish to be limited or restricted to the specific details herein set forth, but wish to reserve to myself any modifications or variations that may appear to those skilled in the art as set forth within the limits of the following claims.

I claim:

1. A soft jaw attachment system for a machine tool vise having supporting ways and opposed flat transversely disposed vise jaw faces with widely spaced longitudinally disposed fastener means openings therethrough, and including;

a soft jaw member for interfaced engagement with the vise jaw faces and in the form of an elongated bar having an initially flat face disposed to interface with one of the aforesaid vise jaw faces and extending transversely with spaced end portions to overly said widely spaced fastener means openings, spaced fastener members and each being in the form of an element engageable with an end portion of the soft jaw bar member to draw it to the vise jaw, at least the jaw member or one of said fastener members being resilient and arcuately formed, such that when said soft jaw is drawn into contiguous interfaced engagement with said vise jaw face by said spaced fastener members, the resilient member is straightened, thereby stressing the soft jaw tightly to said vise jaw face, and fastener means securing each of the spaced fastener members for drawing the soft jaw into interfaced engagement with said vise jaw face.

2. The soft jaw attachment system as set forth in claim 1, wherein the soft jaw member has a coextensive T-shaped channel opening through the flat face at said spaced end portions thereof, and wherein the fastener members are nuts captured in said channel.

3. The soft jaw attachment system as set forth in claim 1, wherein the soft jaw member has a coextensively open T-shaped channel opening through the flat face at said spaced end portions thereof, the channel having coextensive spaced shoulders faced away from said flat face of the soft jaw, and wherein the fastener members are nuts captured against said spaced shoulders.

4. The soft jaw attachment system as set forth in claim 1, wherein the fastener means are threaded fasteners extending through the fastener means openings through the vise jaw and engaging a back side of the vise jaw to be tightened thereagainst.

5. The soft jaw attachment system as set forth in claim 1, wherein the elongated bar having an initially flat face is a resilient and prestressed member.

6. The soft jaw attachment system as set forth in claim 1, wherein the elongated bar having an initially flat face is of resilient material and prestressed by convexly forming the same with a positive camber at the initially flat face thereof.

7. The soft jaw attachment system as set forth in claim 3, wherein the soft jaw is initially formed with the flat face to interface with a vise jaw face, and wherein the spaced fastener members are nuts joined in the form an integral elongated bar of resilient material prestressed by convexly forming the same with a positive camber engageable with and to be flattened against said coextensive spaced shoulders of the soft jaw member.

8. The soft jaw attachment system as set forth in claim 3, wherein the soft jaw is initially formed with the flat face to interface with a vise jaw face, and wherein the spaced fastener members are elongated nuts of resilient material and each extending transversely of the T-shaped channel and concavely formed with a negative camber with spaced ends engageable with and to be flattened against said coextensive spaced shoulders of the soft jaw member.

9. The soft jaw attachment system as set forth in claim 3, wherein the initially flat face elongated bar form of the soft jaw member is of resilient material and prestressed by convexly forming the same with a positive camber at the initially flat face thereof, and wherein the spaced fastener members are nuts joined in the form of an integral elongated bar of resilient material prestressed by concavely forming the same with a negative camber with spaced ends engageable with and to be flattened against said coextensive spaced shoulders of the soft jaw member.

* * * * *